US007360483B2

(12) United States Patent
Romer et al.

(10) Patent No.: US 7,360,483 B2
(45) Date of Patent: Apr. 22, 2008

(54) DEVICE FOR THE GUIDANCE OF LOWER RAMS

(75) Inventors: Harald Romer, Reinbek (DE); Peter Luneburg, Berkentin (DE); Bernd Malner, Schwarzenbek (DE); Hans Wolf, Schwarzenbek (DE)

(73) Assignee: Fette GmbH, Schwarzenbek (DE)

( * ) Notice: Subject to any disclaimer, the term of this patent is extended or adjusted under 35 U.S.C. 154(b) by 0 days.

(21) Appl. No.: 11/734,529

(22) Filed: Apr. 12, 2007

(65) Prior Publication Data

US 2007/0257411 A1 Nov. 8, 2007

(30) Foreign Application Priority Data

May 2, 2006 (DE) ..... 10 2006 020 214

(51) Int. Cl.
*B30B 11/08* (2006.01)

(52) U.S. Cl. ..... 100/238; 100/138; 100/291; 100/906; 425/345; 425/353; 425/DIG. 5

(58) Field of Classification Search ..... 100/102, 100/138, 144, 237, 238, 291, 906; 425/345, 425/353, 361, DIG. 5, 406, 408
See application file for complete search history.

(56) References Cited

U.S. PATENT DOCUMENTS

| | | | | |
|---|---|---|---|---|
| 2,970,554 A | * | 2/1961 | Haupt | 425/219 |
| 3,384,035 A | * | 5/1968 | Gabriel et al. | 425/345 |
| 4,047,866 A | * | 9/1977 | Shah | 425/107 |
| 5,762,978 A | | 6/1998 | Trebbi | 425/345 |

FOREIGN PATENT DOCUMENTS

| | | |
|---|---|---|
| DE | 1 577 251 | 4/1970 |
| DE | 103 18 529 A1 | 11/2004 |

* cited by examiner

*Primary Examiner*—Jimmy T. Nguyen
(74) *Attorney, Agent, or Firm*—Vidas, Arrett & Steinkraus, P.A.

(57) ABSTRACT

A device for the guidance of lower rams across the lower-ram head in a rotor-type rotary press in the area of a filling device wherein a charging cam is disposed between an ejector cam which precedes as viewed in the direction of production and a proportioning cam adjustable in height and is configured such as to lower the heads of the lower rams revolving along with the rotor from the level at the end of the ejector cam to a lower-located transition level of the proportioning cam, a press-mounted, first charging-cam element having a first filling-cam portion joining the ejector cam is provided on which the lower-ram heads are guided solely on the side facing the rotor axis subsequent to the ejector cam, an adjustable second charging-cam element is provided and has a second filling-cam portion on which the lower-ram heads are guided solely on the side facing away from the rotor axis before encountering the proportioning cam, that the second charging-cam element is displaceable both vertically and in the circumferential direction of the rotor for the purpose of varying the filling depth along a predetermined adjustable upward slope, and the first and second charging-cam elements have third, helically shaped filling-cam portions which are located between the first and the second charging cam portion and are located partially opposite each other, and guide the lower-ram heads jointly through a certain length, wherein the upward slope of the third filling-cam portions matches with the adjustable upward slope.

9 Claims, 7 Drawing Sheets

Section F – F

Section D – D

Section E – E

Section D – D

Section D – D

Section E – E

Section E - E

DEVICE FOR THE GUIDANCE OF LOWER RAMS

CROSS-REFERENCE TO RELATED APPLICATIONS

Not applicable.

STATEMENT REGARDING FEDERALLY SPONSORED RESEARCH

Not applicable.

BACKGROUND OF THE INVENTION

The upper and lower rams of a rotary press, which are movable by strokes within a ram guide and interact with bores in the die table, are controlled in height during the rotation of the rotor. The bores are filled with a powder, which requires compaction, by means of a filling device where the lower rams remain inside the bore while the upper rams are above the bore. The filling volume is predetermined by the height positions of the lower rams while filling is done. After compaction, the compacts are thrown out onto the level of the die table, which includes an ejector cam. For an adjustment of the filling volume, the lower rams are pulled down to the filling depth needed in the bore by means of a charging cam. After the filling procedure, the lower rams are moved upwards again by a certain degree in a proportioning station, which causes some fraction of the charge to be batched out, i.e. returned to the filling device. To this effect, a proportioning cam is provided which is infinitely variable in height by means of an appropriate, regulated positioning drive.

Usually, the individual cams are implemented by cam elements which guide the ram heads. This is also the case for the charging cam. It is known to provide charging cams having different filling height stages. If a major filling volume is necessary a charging cam of a major adjustable depth is chosen, and vice versa. The accurate filling volume is set by a more or less large stroke of the proportioning cam. If the batching-out strokes of the proportioning cam are large it might happen that powder which was proportioned back to the filling device leads to problems in filling, e.g. because of clogging, undesirable compression of the powder within the filling device, lumping of the powder, etc. In such cases, it might be necessary to exchange the charging cam against a more suitable one, e.g. one of a smaller filling depth.

A change-over to another charging cam possibly may also be required if the tablet output of the machine is increased. It has turned out that if the position of the lower rams remains the same the material volume loaded into the bores is the smaller the higher is the speed of the rotor From a certain circumferential speed onwards, the remaining filling time is too small for filling up the bore with powder completely. The consequence is that a precise filling volume can no longer be achieved by batching out material in the proportioning station. Also here, it may be necessary to vary the filling depth, i.e. increase it here, in order to give the compact its desired weight.

Exchanging a charging cam involves a great expenditure in both assembly and time. For this purpose, it is necessary to dismount the machine cladding elements and remove the powder filling device from the machine. It further requires the disassembly of several lower rams and drawing off the powder that is in the press. The production process of the press naturally is disrupted during the resetting period.

It is the object of the invention to provide a device for the guidance of lower rams across their lower-ram heads in a rotor-type rotary press in the area of a filling device which remedies the disadvantages described and allows varying the filling depth with no major expenditure.

BRIEF SUMMARY OF THE INVENTION

In the first inventive device a first press-mounted charging-cam element is provided and has a first filling-cam portion joining the ejector cam. The heads of the lower rams always leave the ejector cam at the same level. Therefore, the first filling-cam portion is disposed such as to pass the ram heads over to them with no step. However, a guide in the first filling-cam portion exclusively exists on the side of the ram head that faces the rotor axis. A second adjustable charging-cam element is provided, which can be mounted at different positions on the first charging-cam element. The second adjustable charging-cam element has a second filling-cam portion on which the lower-ram heads are guided solely on the side facing away from the rotor axis. The second filling-cam portion is adjacent to the proportioning cam and its object is that of directing the lower-ram heads to the ascending ramp of the proportioning cam. The second charging-cam element is adjustable both in height, i.e. vertically, and the circumferential direction of the rotor. Thus, an adjustment in height implies a different filling depth. Thus, the filling depth is governed by the position of the second charging-cam element. The heads of the lower rams encounter the ramp leading to the proportioning cam at different levels. Though, it is understood that the relative positions of the second filling-cam portion and proportioning cam should not go beyond a certain ratio, which means that the original position of the proportioning cam has to be adapted to the filling depth and, hence, the position of the second charging-cam element.

The two charging-cam elements present helically shaped third filling-cam portions each which are located between the first and the second charging cam portion and are located partially opposite each other. They are configured such as to guide the lower-ram heads jointly through a certain length. As the upward slope of the third charging cam portions matches with the upward slope along which the second charging cam element is adjustable a steady transition results between the individual cam portions independently of the position of the second charging cam element with the lower-ram heads not sustaining a shock while being guided in the area of the filling device.

Hence, the invention allows for a variation of the filling depth because of the particularity of the charging-cam elements where the variation can be made without any steps or even at fixed steps by hand or a motor. Therefore, an exchange of the charging cam is no longer necessary when the filling depth changes.

The second inventive solution provides for an adjustable charging-cam element is provided which has thee successive filling-cam portions in the direction of motion of the rotor. The nature of the first filling-cam portion is such that the lower-ram heads enter the charging-cam element regardless of the height adjusted. As mentioned above, the lower-ram heads are at the same height when reaching the charging cam. However, since the inventive charging-cam element is adjustable in height it must be ensured in this case that the lower-ram heads may pass smoothly into the charging-cam element. The second filling-cam portion is ramp-shaped and presets the downward incline along which the lower-ram heads run. The third cam portion joins the second one and has a different relative height with regard to the succeeding proportioning cam that depends on the setting of the charging-cam element. This provision also allows to achieve a variation of the filling depth within limits. As compared to the solution of the first invention device, its disadvantage is that the lower-ram heads, in various settings of the charging-cam element, strike against the cam path under an angle even though it is small.

As mentioned already, the second charging-cam element has a predetermined variation path with regard to the press-mounted first charging-cam element that preferably is predetermined by a cam element guide. This guide may be a groove-type or spring-type guide or alternatively a pin/groove-type guide, for example. It is understood that the second charging-cam element is located in place with respect to the first charging-cam element according to a predetermined variation path. Embodiments of the invention will be described in more detail below with reference to the drawings.

DETAILED DESCRIPTION OF THE INVENTION

While this invention may be embodied in many different forms, there are described in detail herein a specific preferred embodiment of the invention. This description is an exemplification of the principles of the invention and is not intended to limit the invention to the particular embodiment illustrated.

Figure 1:
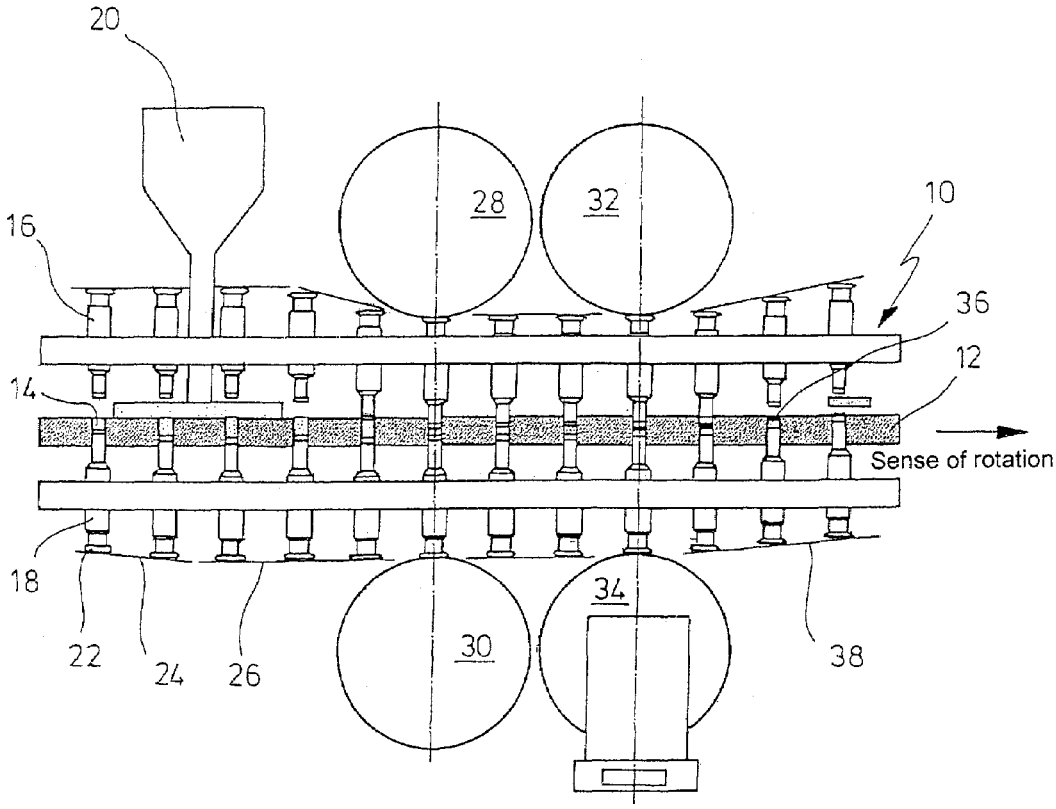
FIG. 1 shows the functional diagram of a rotary press as a developed view of the pitch circle diameter.

FIG. 1 shows a rotor 10 for a tablet rotary press as a developed view. The rotor has a die-plate 12 with bores 14 with which pairs of upper rams 16 and lower rams 18 interact. A filling device 20 charges the powder requiring compaction into the bores 14 if they pass along the filling device 20. The lower rams 18 then have a position which predetermines the filling volume. During the charging procedure, the lower rams make their heads 22 move along a charging cam 24 which has a downward inclination. What then follows is a proportioning cam 26 by which the lower rams 18 are raised again a little bit in order to batch the volume in the bores The batched-out volume is received by the filling device 20. The powder is compacted in the bores 14 at two successive compression stations having pre-compression rollers 28, 30 and main compression rollers 32, 34. The upper rams 16 gradually are moved out of the bores 14 and the lower rams expel the compacts, which are designated by 36, from the bores 14. For this purpose, the lower rams 18 are moved upwards by an ejector cam 38. Thus, the ejector cam 38 is followed by the charging cam 24 in the direction of production, which is from left to right in FIG. 1.

Figure 6:
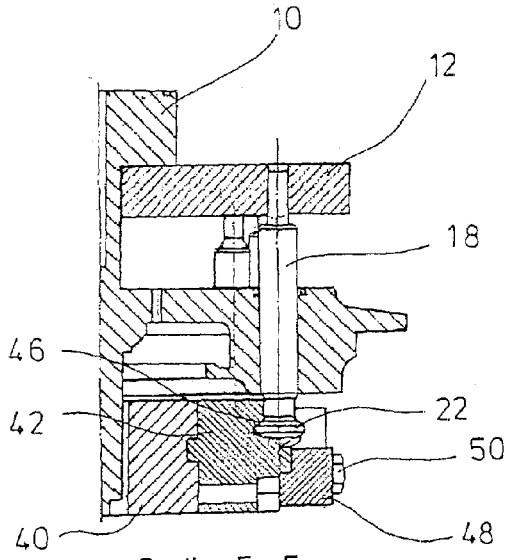
FIG. 6 shows the sections through FIGS. 2 and 5 at the indicated positions.
Figure 6:
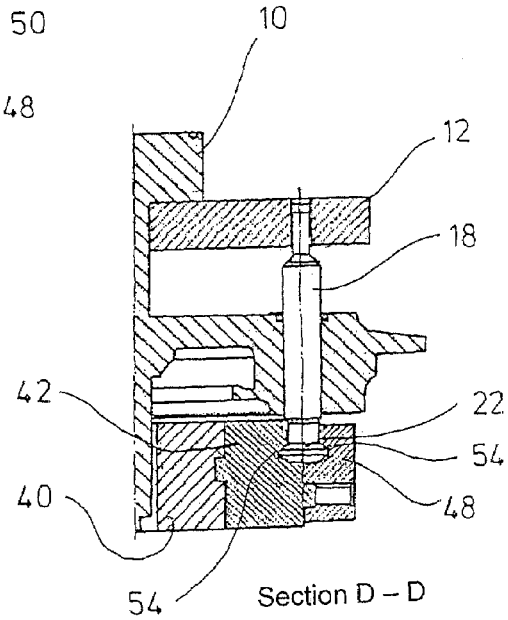
Figure 6:
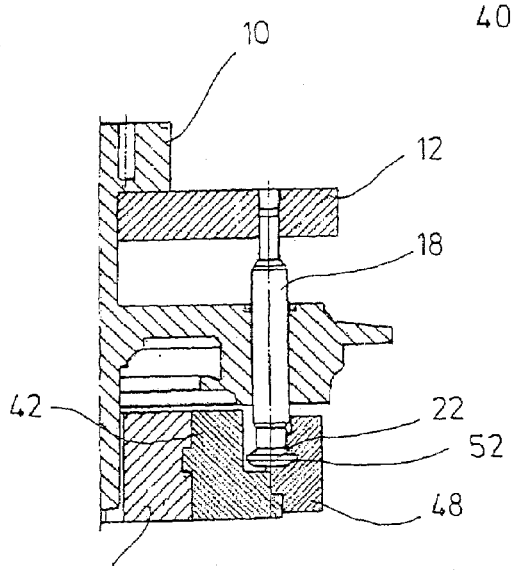
Figure 7:
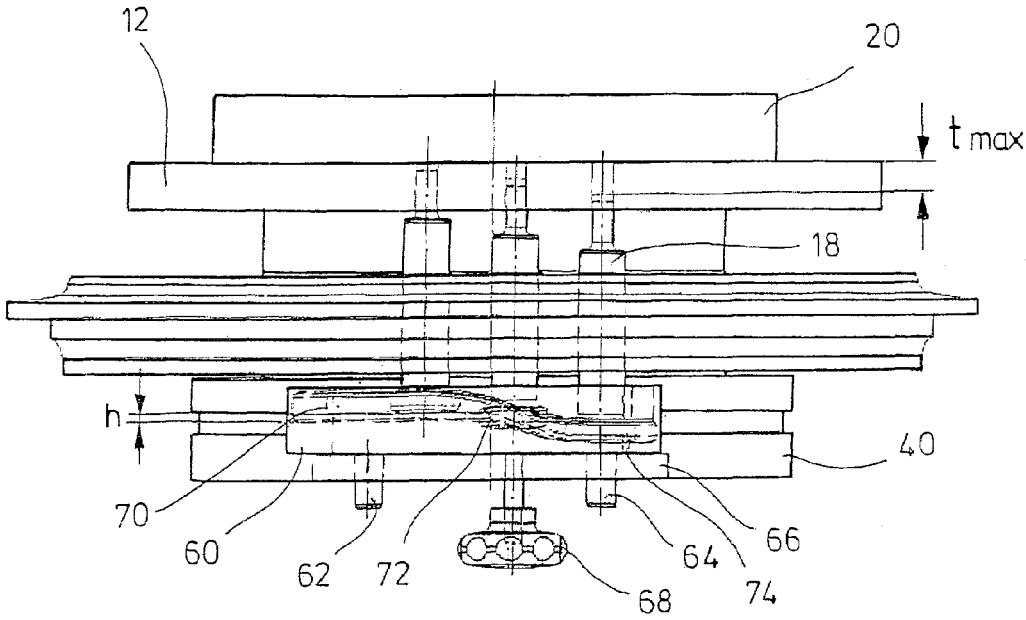
FIG. 7 shows a side view of a second embodiment of a charging cam according to the invention at a maximal filling depth.
Figure 8:
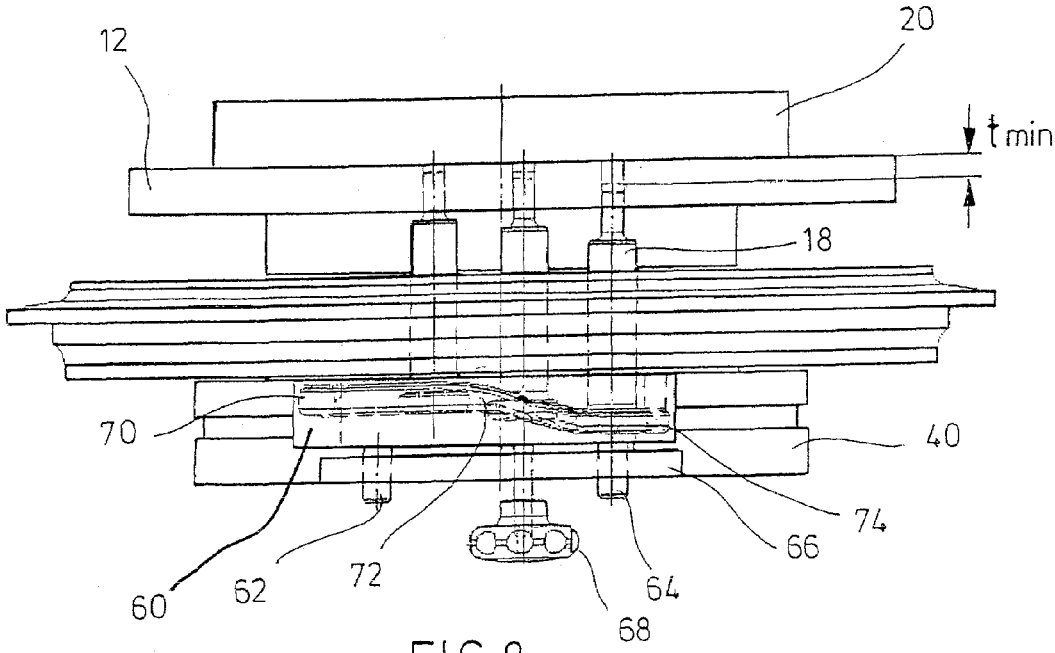
FIG. 8 shows a side view similar to FIG. 7, but at a minimal filling depth.
Figure 9:
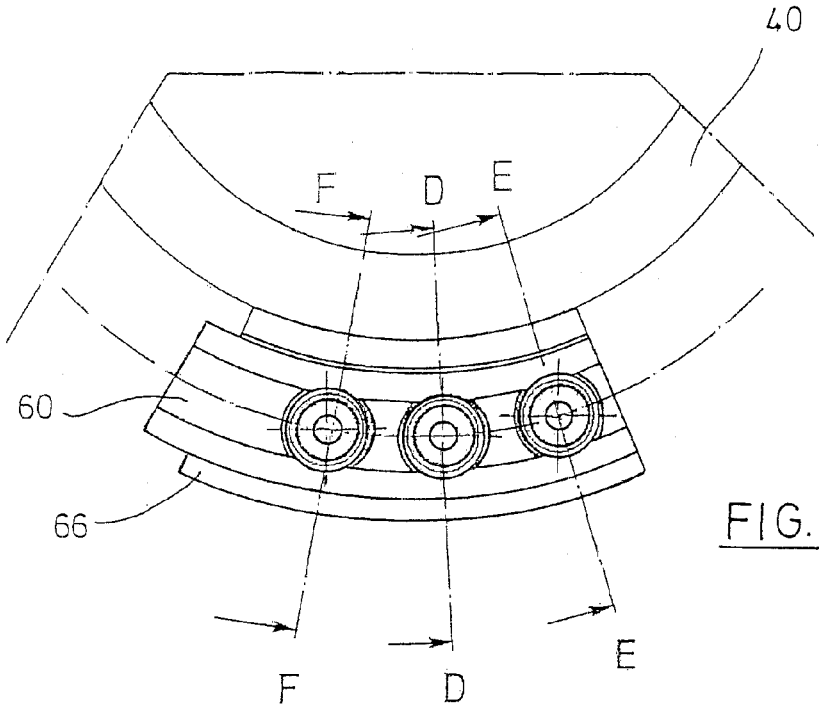
FIG. 9 shows a plan view of the charging cam of FIGS. 7 and 8.
Figure 10:
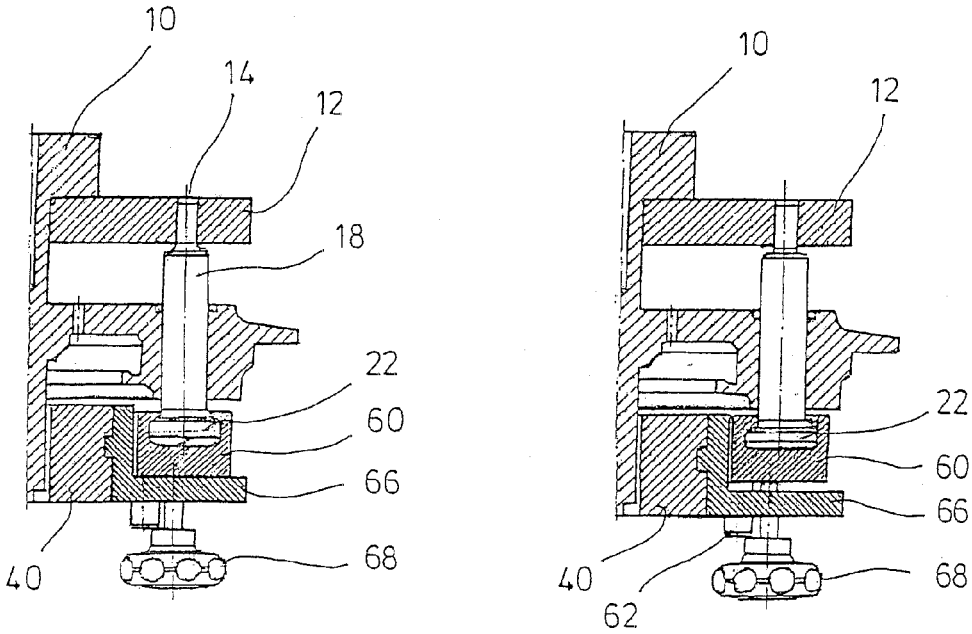
FIG. 10 shows the aforementioned section through the representation of FIG. 9 at different filling depths.

The charging cam 24 alone will be discussed below,

FIGS. 2 to 6 allow to identify a bearing component (lower cam carrier) 40 which is disposed in a press-mounted relationship. It carries a press-mounted first cam element 42 having a first charging cam 46. The outside of the press-mounted first charging-cam element 42 has fixed thereon a second charging-cam element 48. The cam elements 42, 48 engage each other via a groove and spring-type joint which has a predetermined upward slope oblique to the horizontal as ensues from FIGS. 2 and 4. The position relative to each other is fixed by a screw 50. The second cam element 48 has a second charging cam 52 (FIG. 6—Section E-E). The cam elements 42, 48 further, have third charging-cam portions 54 (FIG. 6—Section D-D) which act together and extend along a helically shaped path. The groove and spring-type guide has the same upward slope so that if there is a relative displacement between the cam elements, which is both vertical and horizontal, the common charging-cam portions 54 always are oriented towards each other and guide the heads of the lower rams together as is illustrated in FIG. 6. In the first charging-cam element 42, the heads 22 are guided only in the first cam portion 46 on the side facing the rotor axis while the other side of the heads 22 is vacant (FIG. 6—Section F-F). In the second cam element of FIG. 6—Section E-E, guidance is performed exclusively by the second charging-cam portion 52.

Figure 2:
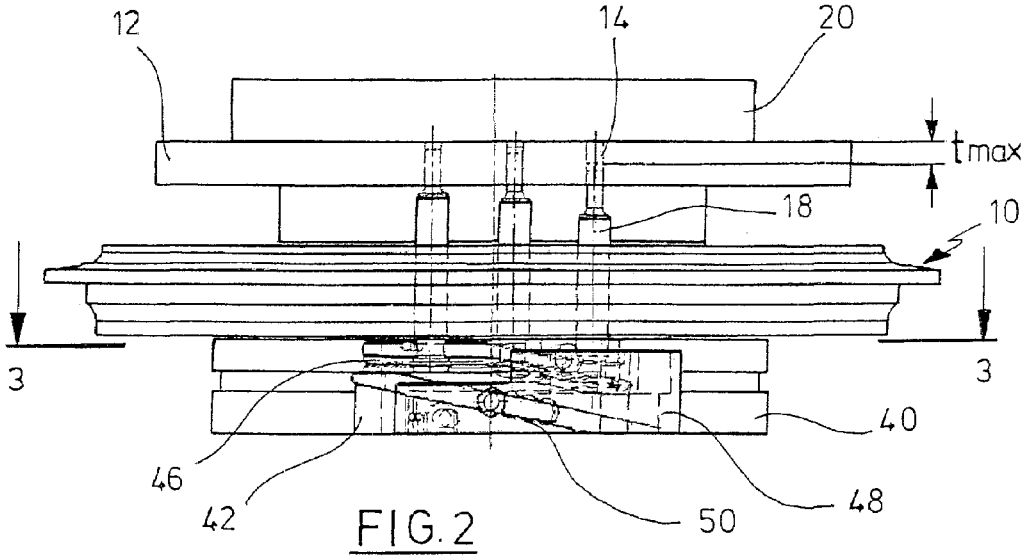
FIG. 2 shows an embodiment of a charging cam according to the invention in a side view.
Figure 3:
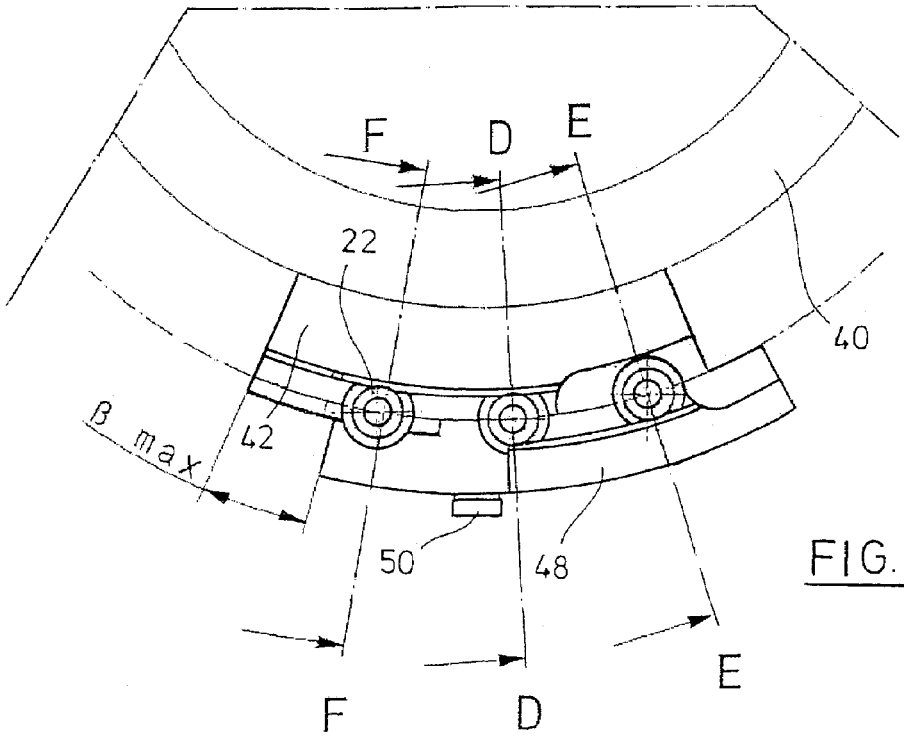
FIG. 3 shows a plan view of the charging cam of FIG. 2.

No matter what the relative position of the cam element 48 is towards the cam element 42, a permanent transition exists from the inner charging-cam portion 46 to the charging-cam portion 54 and, hence, to the charging-cam portion 52. However, a different relative position will result in a different position of the end of the charging-cam portion 52. In the positions of FIG. 2, the lower rams 18 are moved down at a maximum within the displacement path of the second charging-cam element 48. Hence, the filling depth of the bores 14 is maximal as is also indicated by tmax in FIG. 2 In FIG. 4, the filling depth of the lower ram 18 is minimal as is indicated by tmin. If the filling depth is a maximum the second charging-cam element 48 is displaced to the right maximally with respect to the fixed charging-cam element 42, which is indicated by ?max. If the filling depth is a minimum the displaceable charging-cam element 48 is pivoted through the least path with respect to the fixed charging-cam element 42 as is shown by ?min in FIG. 5.

Figure 4:
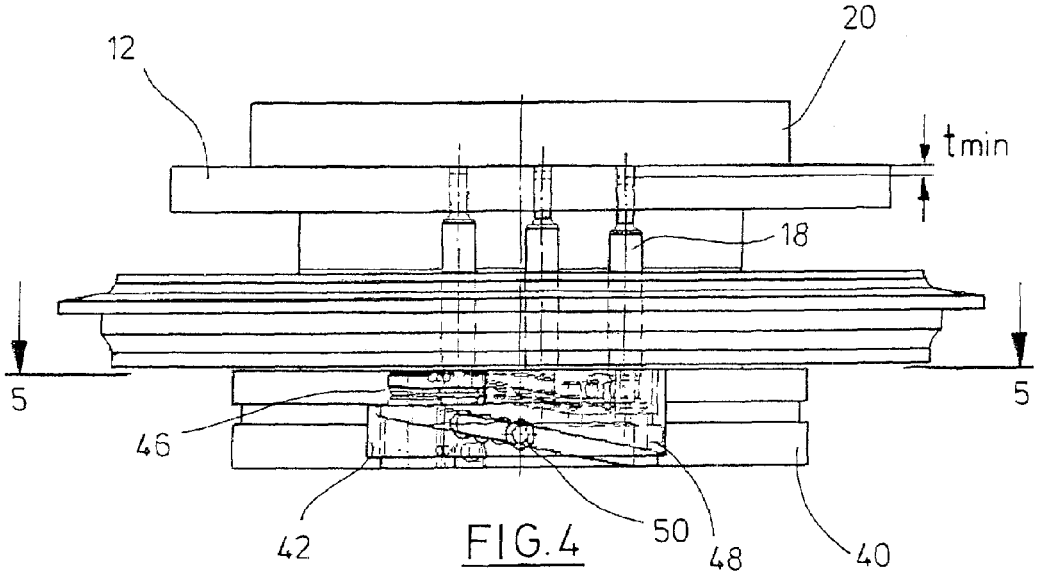
FIG. 4 shows a side view similar to FIG. 2, but in a minimal filling position.
Figure 5:
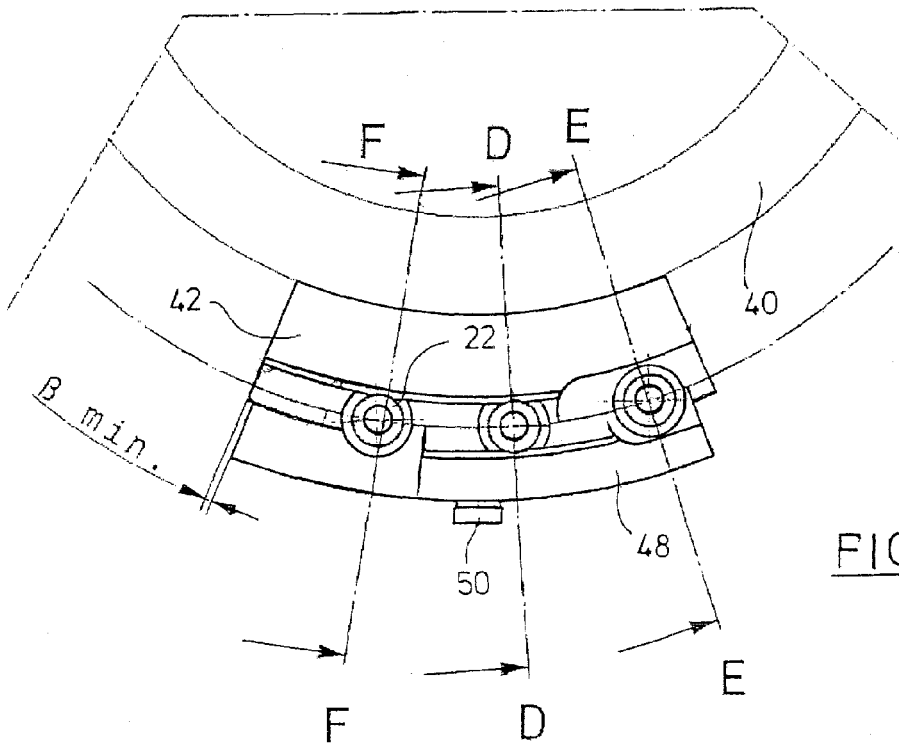
FIG. 5 shows a plan view of the charging cam of FIG. 4.

FIGS. 2 and 4 suggest that the displacement of the displaceable charging-cam element is performed by four steps since a fixation via the screw 50 is only possible by four steps. It is understood that a continuous shift between minimum and maximum filling depths is possible as well. Furthermore, such displacement may be made via a motor.

The same reference numbers are used as far as the components shown in FIGS. 7 to 12 are identical to those of FIG. 1.

Referring to FIGS. 7 to 12, the bearing component (lower cam carrier) 40 has arranged thereon a charging-cam element 60 which is movable in height. At its underside, the element has two guide pins 62, 64 which are guided to be movable in height inside bores of a plate 66 of the bearing component 40. The plate 66 is engaged from below by an adjusting screw 68 the shank end of which bears against the underside of the block-like charging-cam element 60. The charging-cam element 60 may be adjusted in height, depending on the position of the adjusting screw 68. The stroke h is outlined in FIG. 7. This allows a variation of the filling depth between tmax and tmin as per FIG. 7 and FIG. 8 via the charging-cam portions in the charging-cam element 60, reference to which will be made at once.

The charging-cam element 60 has three charging-cam portions which follow each other in the sense of rotation, i.e. a first charging-cam portion 70, a second charging-cam portion 72, and a third charging-cam portion 74. The charging-cam portions 70, 74 are horizontal, but are offset from each other in height. The second charging-cam portion 72 has a gradient by which the lower rams 18 are pulled to a lower level which matches the desired filling depth. The first charging-cam portion 70 has a relatively large entry height and, thus, enables the heads 22 of the lower rams 18 to enter irrespective of the adjustable height position of the charging-cam element 60. This can be recognized in FIG. 10. In the left-hand representation of FIG. 10, the charging-cam element 60 is lowered to a maximum and the head 22 enters in the upper region of the first charging-cam portion. In the right-hand representation of FIG. 10, the charging-cam element 60 is raised to a maximum so that the head 22 enters in the lower region of the first charging-cam portion.

Figure 11:
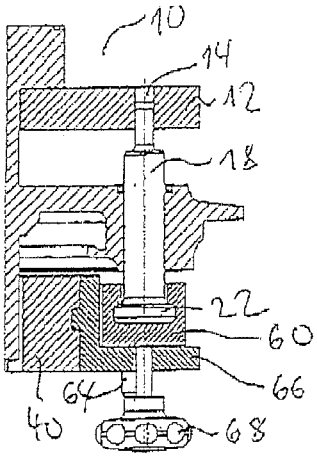
FIG. 11 shows the aforementioned section through the representation of FIG. 9 at different filling depths.
Figure 11:
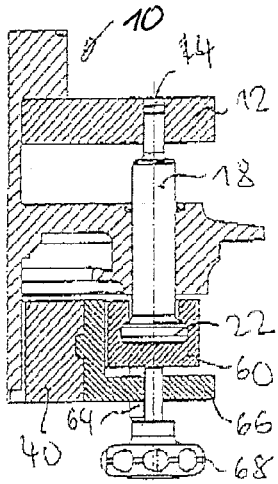
Figure 12:
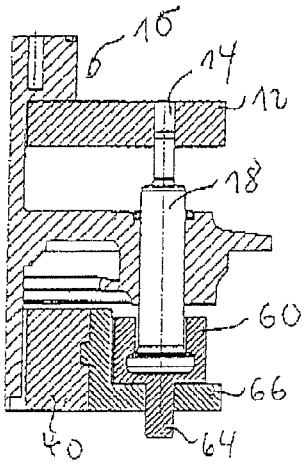
FIG. 12 shows the aforementioned section through the representation of FIG. 9 at different filling depths.
Figure 12:
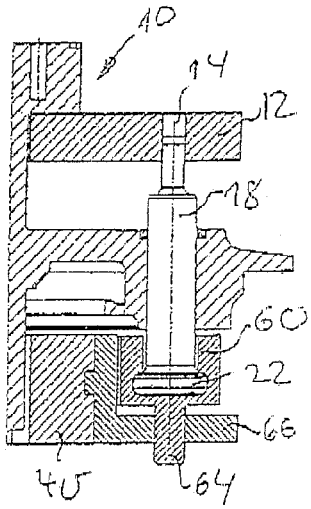

Referring to FIGS. 11 and 12, the maximum filling depth is always indicated at left and the minimum filling depth is indicated at light.

The above disclosure is intended to be illustrative and not exhaustive. This description will suggest many variations and alternatives to one of ordinary skill in this art. All these alternatives and variations are intended to be included within the scope of the claims where the term "comprising" means "including, but not limited to". Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

What is claimed is:

1. A device for a guidance of lower rams, across lower ram heads in a rotor-type rotary press in an area of a filling device wherein a charging cam is disposed between an ejector cam which precedes as viewed in a direction of production and a proportioning cam adjustable in height and is configured to lower the heads of the lower rams revolving along with a rotor from a level at an end of the ejector cam to a lower-located transition level of the proportioning cam, characterized in that a press-mounted, first charging-cam element (42) having a first filling-cam portion (46) joining the ejector cam is provided on which the lower-ram heads (22) are guided solely on a side facing a rotor axis subsequent to the ejector cam (38), an displaceable second charging-cam element (48) is provided and has a second filling-cam portion (52) on which the lower-ram heads (22) are guided solely on a side facing away from the rotor axis before encountering the proportioning cam (26), that the second charging-cam element (48) is variable both vertically and in a circumferential direction of the rotor (10) for a purpose of varying a filling depth (t) along a predetermined adjustable upward slope, and the first and second charging-cam elements (42, 48) have third, helically shaped filling-cam portions (54) which are located between the first and second filling-cam portions (46, 52) and are located partially opposite each other, and guide the lower-ram heads (22) jointly through a certain length, wherein an upward slope of the third filling-cam portions (54) matches with the adjustable upward slope.

2. A device for the guidance of lower rams, across lower-ram heads in a rotor-type rotary press in an area of a filling device wherein a charging cam is disposed between an ejector cam (38) which precedes as viewed in a direction of production and a proportioning cam (26) adjustable in height and is configured to lower the heads of the lower rams revolving along with a rotor from a level at the end of the ejector cam to a lower-located transition level of the proportioning cam, characterized in that a vertically adjustable charging-cam element (60) is provided, the vertcally adjustable charging-cam element (60) is adjustable by an adjusting member which interacts with an underside of the charging-cam element (60), the vertically adjustable charging-cam having three successive filling-cam portions (70, 72, 74) formed therein in a direction of motion of the rotor (10), the nature of the first filling-cam portion (70) is such that the lower-ram heads (22) enter the charging-cam element (60) regardless of the height adjusted, and the second filling-cam portion (72) is ramp-shaped with a downward incline which extends towards the lower-located third filling-cam portion (74).

3. The device according to claim 1, characterized in that the displaceable charging-cam element (48, 60) is adjusted in an infinitely variable way or by predetermined steps.

4. The device according to claim 3, characterized in that the displaceable charging-cam element (48, 60) is varied by means of an adjustable drive.

5. The device according to claim 1, characterized in that the second charging-cam element (48) is guided along a cam element guide.

6. The device according to claim 5, characterized in that the cam element guide is defined by a groove-type or spring-type guide or a pin/groove-type guide.

7. The device according to claim 1, characterized in that the second charging-cam element (48) is adapted to be fixed to the first charging-cam element (42 by means of a screw (50).

8. The device according to claim 2, characterized in that the charging-cam element (60) has two guide pins (62, 64) which are guided inside guide bores of a bearing component (40, 66).

9. The device according to claim 8, characterized in that the bearing component (40, 66) for the charging-cam element (60) has supported therein the adjusting member (68) which interacts with the underside of the charging-cam element (60).

* * * * *